US005482257A

United States Patent [19]

Holcombe et al.

[11] Patent Number: 5,482,257

[45] Date of Patent: Jan. 9, 1996

[54] NON-GRAPHITE CRUCIBLE FOR HIGH TEMPERATURE APPLICATIONS

[75] Inventors: Cressie E. Holcombe, Knoxville; William A. Pfeiler, Norris, both of Tenn.

[73] Assignee: Martin Marietta Energy Systems, Inc., Oak Ridge, Tenn.

[21] Appl. No.: 186,837

[22] Filed: Jan. 25, 1994

Related U.S. Application Data

[63] Continuation-in-part of Ser. No. 951,742, Sep. 25, 1992, Pat. No. 5,333,844.

[51] Int. Cl.[6] ..... B22D 41/00

[52] U.S. Cl. ..... 266/275; 266/285; 432/262

[58] Field of Search ..... 266/285, 280, 266/275, 287; 432/253, 262, 264, 265

[56] References Cited

U.S. PATENT DOCUMENTS

| | | | |
|---|---|---|---|
| 2,472,456 | 6/1949 | Anicetti | 263/48 |
| 2,532,389 | 12/1950 | Batcheller | 91/12.2 |
| 2,842,353 | 7/1958 | Priola | 266/39 |
| 2,854,048 | 9/1958 | Cunningham | 150/0.5 |
| 4,131,265 | 12/1978 | McCray | 266/275 |
| 4,403,955 | 9/1983 | Sarno | 432/158 |
| 4,492,572 | 1/1985 | Linn | 432/263 |
| 4,550,412 | 10/1985 | Holcombe et al. | 373/155 |
| 4,609,425 | 9/1986 | Mateika et al. | 156/617 |
| 4,687,646 | 8/1987 | Mateika et al. | 422/248 |
| 4,708,326 | 11/1987 | Brockmeyer et al. | 266/159 |

OTHER PUBLICATIONS

J. Libsch and L. Capalong, "*Use of Susceptors in Induction Heating*", High Frequency Heating Review, pp. 3–8, 11. Dec. 1988.

C. E. Holcombe Jr., N. L. Dykes, and D. R. Masters, "*Noncarbon Furnace for Vacuum Induction Melting of Uranium and Its Alloys*", Journal of Nuclear Materials 160 Dec./(1988) pp. 98–100.

C. E. Holcombe Jr., R. H. Reiner, and N. L. Dykes, "*Use of Tribocor 532N For A Carbon–Free Induction Furnace For Vacuum–Induction Melting and Casting of Uranium and Its Alloys*", Journal of Materials Science Letters 6 Dec./(1987) pp. 1353–1355.

*Primary Examiner*—Scott Kastler

*Attorney, Agent, or Firm*—Ivan L. Ericson; James K. Davis; Harold W. Adams

[57] ABSTRACT

A multi-piece crucible for high temperature applications comprises a tubular side wall member having a lip on the inside surface and a bottom member or members forming a container for containing a melt of a material during a high temperature melt-casting operations. The multi-piece design prevents cracking of the crucible or leakage of the melt from the crucible during the melt-casting operation. The lip of the tubular member supports the bottom member. The contacting surfaces where the lip of the tubular side wall member contacts the bottom member of the multi-piece crucible contains a ceramic sealing material. The ceramic sealing material forms a seal sufficient to prevent the melt of the material from leaking out of the multi-piece crucible during the melt-casting process. The multi-piece crucible is made of a material which is chemically inert to the melt and has structural integrity at the melting point temperature of the melt, or of a material coated with such a material. The multi-piece crucible is contained in a thermal can assembly of a high temperature induction furnace during a high temperature melt-casting operation. One embodiment of the multi-piece crucible comprises a tubular member having a vertical slot filled with a ceramic sealing material to provide expansion of the tubular member without cracking during the high temperature melt-casting operation.

13 Claims, 9 Drawing Sheets

NON-GRAPHITE CRUCIBLE FOR HIGH TEMPERATURE APPLICATIONS

This invention was made with Government support under contract DE-AC0584OR21400 awarded by the U.S. Department of Energy to Martin Marietta Energy Systems, Inc. and the Government has certain rights in this Invention.

CROSS-REFERENCE TO RELATED APPLICATION

This Application is a continuation-in-part application under 37 CFR §1.53 of U.S. patent application Ser. No. 07/951,742, filed on Sep. 25, 1992, now U.S. Pat. No. 5,333,844, the entire disclosure of which is incorporated herein by reference.

FIELD OF THE INVENTION

The present invention relates to a crucible, more particularly, to a crucible for high temperature applications.

BACKGROUND OF THE INVENTION

Large non-graphite crucibles utilized for melting high melting point materials have a tendency to crack during the melt-casting process because of excessive mechanical stresses that develop within the crucible due to nonuniform heating of the crucible. The cracks occur primarily at the juncture of the bottom and the side wall of the crucible as well as radial cracks emanating from the center of the crucible bottom. The larger the crucible the more susceptible it is to cracking. It is desirable to reduce the labor and energy costs of the melt-casting process by reducing the time required to complete the process and to maximize the service life of the crucible. Therefore, it is very important to provide a non-graphite crucible which will not crack during the melt-casting cycle of the material. In addition, carbon contamination caused by the crucibles used in reactive melt processing is a serious problem. Therefore, it is important to prevent such contamination.

OBJECTS OF THE INVENTION

Accordingly, it is an object of the present invention to provide a non-graphite crucible for high temperature applications which will not crack or leak during the melting processing of a high melting point material.

Further and other objects of the present invention will become apparent from the description contained herein.

SUMMARY OF THE INVENTION

In accordance with one aspect of the present invention, a new and improved multi-piece crucible for high temperature applications comprises a tubular member and a bottom member. The tubular member has a centerline, an inner side wall, a lower portion, a thickness, and a lip. The lip is located on the inner side wall of the lower portion of the tubular member. The lip has a tapered side tapered in a downward direction toward the centerline of the tubular member. The bottom member has an outer side tapered in an upward direction toward the tubular member at an angle that provides a matching fit with the tapered side of the lip for enclosing the lower portion of the tubular member to form the crucible for containing a melt of a material in high temperature casting operations. The outer side of the bottom member contacts the tapered side of the lip to form a seal sufficient to contain a melt of a material used in high temperature casting operations. The lip of the tubular member supports the bottom member. The crucible or a coating on the crucible is made of a material chemically inert to the melt and has structural integrity at the melting point temperature of the melt.

In accordance with another aspect of the present invention, a new and improved multi-piece crucible for high temperature applications comprises a tubular member and a bottom member. The tubular member has a centerline, an inner side wall, a lower portion, a thickness, and a lip. The lip is located on the inner side wall of the lower portion of the tubular member. The lip has a tapered side tapered in a downward direction toward the centerline of the tubular member. The bottom member has an outer side tapered in an upward direction toward the tubular member at an angle that provides a matching angle with the tapered side of the lip for enclosing the lower portion of the tubular member to form the crucible for containing a melt of a material in high temperature casting operations. The outer side of the bottom member contacts a ceramic sealing material and the tapered side of the lip contacts the ceramic sealing material to form a seal sufficient to contain melts of materials used in high temperature casting operations. The lip of the tubular member supports the bottom member. The crucible or a coating on the crucible is made of a material chemically inert to the melt and has structural integrity at the melting point temperature of the melt.

In accordance with another aspect of the present invention, a new and improved multi-piece crucible for high temperature applications comprises a tubular member and a bottom member. The tubular member has an inner side wall, a lower portion, and a lip. The lip is located on the inner side wall of the lower portion of the tubular member. The lip has a side and a top portion. The bottom member has an outer side and a bottom portion. The outer side of the bottom member has a periphery. The inner side wall has a periphery. The periphery of the outer side of the bottom member is smaller than the periphery of the inner side wall. The bottom portion of the bottom member contacts the lower portion of the tubular member to form a seal sufficient to contain a melt of a material used in high temperature casting operations. The lip of the tubular member supports the bottom member. The crucible or a coating on the crucible is made of a material chemically inert to the melt and has structural integrity at the melting point temperature of the melt.

In accordance with another aspect of the present invention, a new and improved multi-piece crucible for high temperature applications comprises a tubular member and a bottom member. The tubular member has an inner side wall, a lower portion, and a lip. The lip is located on the inner side wall of the lower portion of the tubular member. The lip has a side and a top portion. The bottom member has a side and a bottom portion. The lip of the tubular member supports the bottom member. The side of the bottom member contacts a ceramic sealing material and the side of the lip contacts the ceramic sealing material to form a seal sufficient to contain melts of materials used in high temperature casting operations. The crucible or a coating on the crucible is made of a material chemically inert to the melt and has structural integrity at the melting point temperature of the melt.

In accordance with another aspect of the present invention, a new and improved multi-piece crucible for high temperature applications utilizing large diameter crucibles comprises a multi-piece crucible having more than two pieces. The crucible comprises a tubular member and two bottom members, a first bottom member and a second bottom member. The second bottom member fits inside the first bottom member. The tubular member has a centerline, an inner side wall, a lower portion, a thickness, and a lip. The lip is located on the inner side wall of the lower portion of the tubular member. The lip has a tapered side tapered in a downward direction toward the centerline of the tubular member. The first bottom member has an outer side and an inner side. The outer side of the first bottom member is tapered in an upward direction toward the tubular member at an angle that provides a matching fit with the tapered side of lip. The inner side of the first bottom member is tapered in a downward direction toward the centerline of the tubular member. The second bottom member has an outer side. The outer side of the second bottom member is tapered in an upward direction toward the tubular member at an angle that provides a matching fit with the inner side of the first bottom member. The first and second bottom members enclose the lower portion of the tubular member to form the multi-piece crucible for containing a melt of a material in high temperature casting operations. The outer side of the first bottom member contacts the tapered side of the lip of the tubular member and the outer side of the second bottom member contacts the inner side of the first bottom member both forming a seal sufficient to contain a melt of a material used in high temperature casting operations. The lip of tubular member supports the first bottom member and the first bottom member supports the second bottom member. The crucible or a coating on the crucible is made of a material chemically inert to the melt and has structural integrity at the melting point temperature of the melt.

For a better understanding of the present invention, together with other and further objects, advantages and capabilities thereof, reference is made to the following disclosure and appended claims.

For a better understanding of the present invention, together with other and further objects, advantages and capabilities thereof, reference is made to the following disclosure and appended claims in connection with the above-described drawing.

DETAILED DESCRIPTION OF THE PREFERRED EMBODIMENTS

Ceramic crucibles are utilized for melting refractory metals and alloys in high temperature casting operations. However, ceramic materials are inherently brittle and relatively poor conductors of heat. Consequently, mechanical stress is generated during the heating cycle by temperature differentials that occur within the sidewalls and the bottom of the crucible. As a result, cracks are formed usually in the bottom of the crucible. To overcome the cracking problem the crucible of the present invention is made from more than one piece to accommodate the stresses that are generated in the crucible during the high temperature heating cycles of the melting and casting process.

Several crucible designs were prepared and tests were run to evaluate the effectiveness of the concept of a multi-piece crucible to solve the cracking problems encountered with single-piece crucibles.

Figure 1:
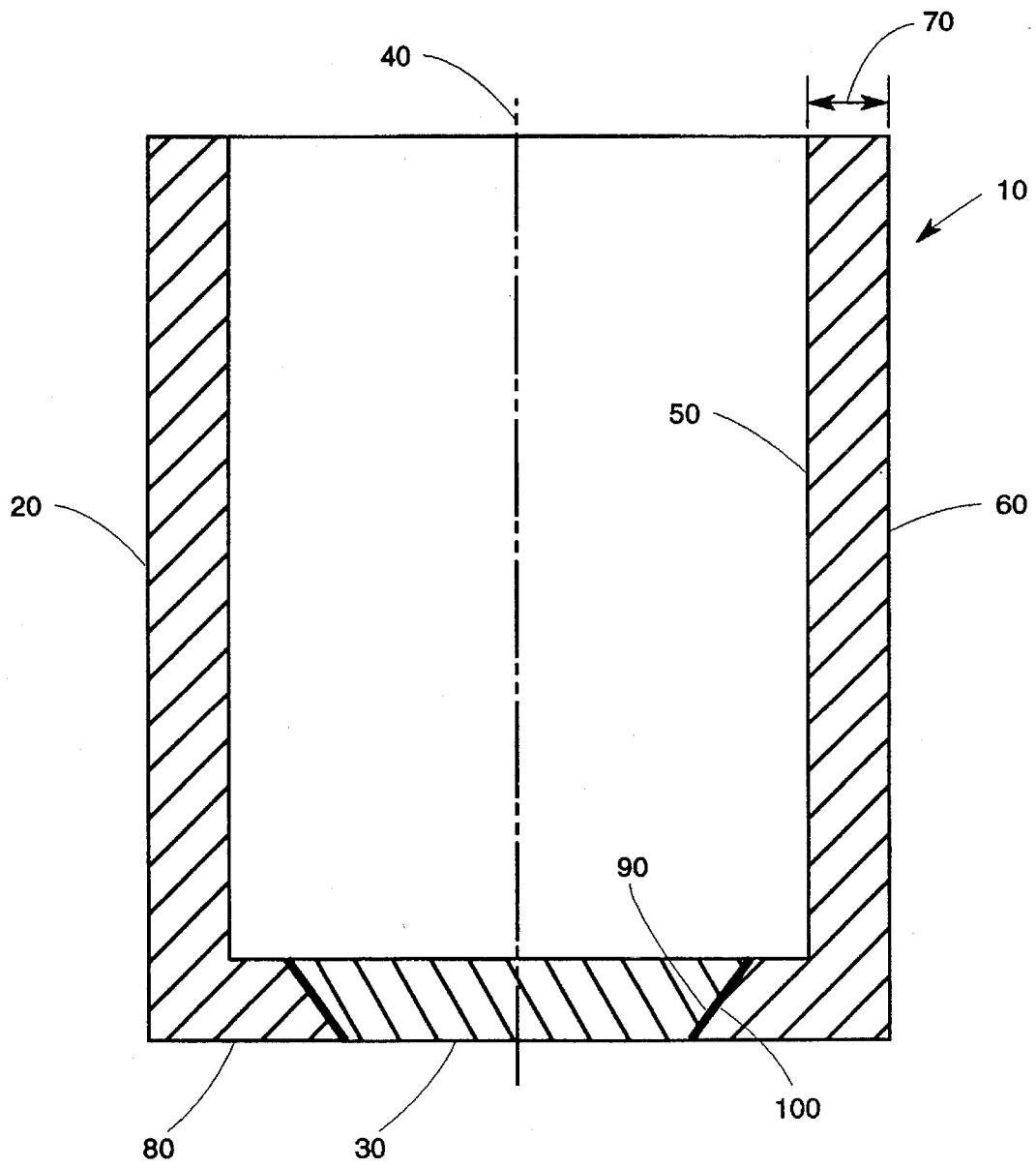
FIG. 1 is cross-sectional view an embodiment of a multi-piece crucible in accordance with the present invention.

Shown in FIG. 1 is a cross-sectional view of one embodiment of the present invention. Crucible 10 comprises tubular member 20 and bottom member 30. Tubular member 20 has centerline 40, inner side wall 50, lower portion 60, thickness 70, and lip 80. Lip 80 is located on inner side wall 50 of Lower portion 60 of tubular member 20. Lip 80 has tapered side 90 tapered in a downward direction toward centerline 40 of tubular member 20. Bottom member 30 has outer side 100 tapered in an upward direction toward tubular member 20 at an angle that provides a matching fit with tapered side 90 of lip 80 for enclosing lower portion 60 of tubular member 20 to form crucible 10 for containing a melt of a material in high temperature casting operations. Outer side 100 of bottom member 30 contacts tapered side 90 of lip 80 to form a seal sufficient to contain a melt of a material used in high temperature casting operations. Lip 80 of tubular member 20 supports bottom member 30.

Figure 2:
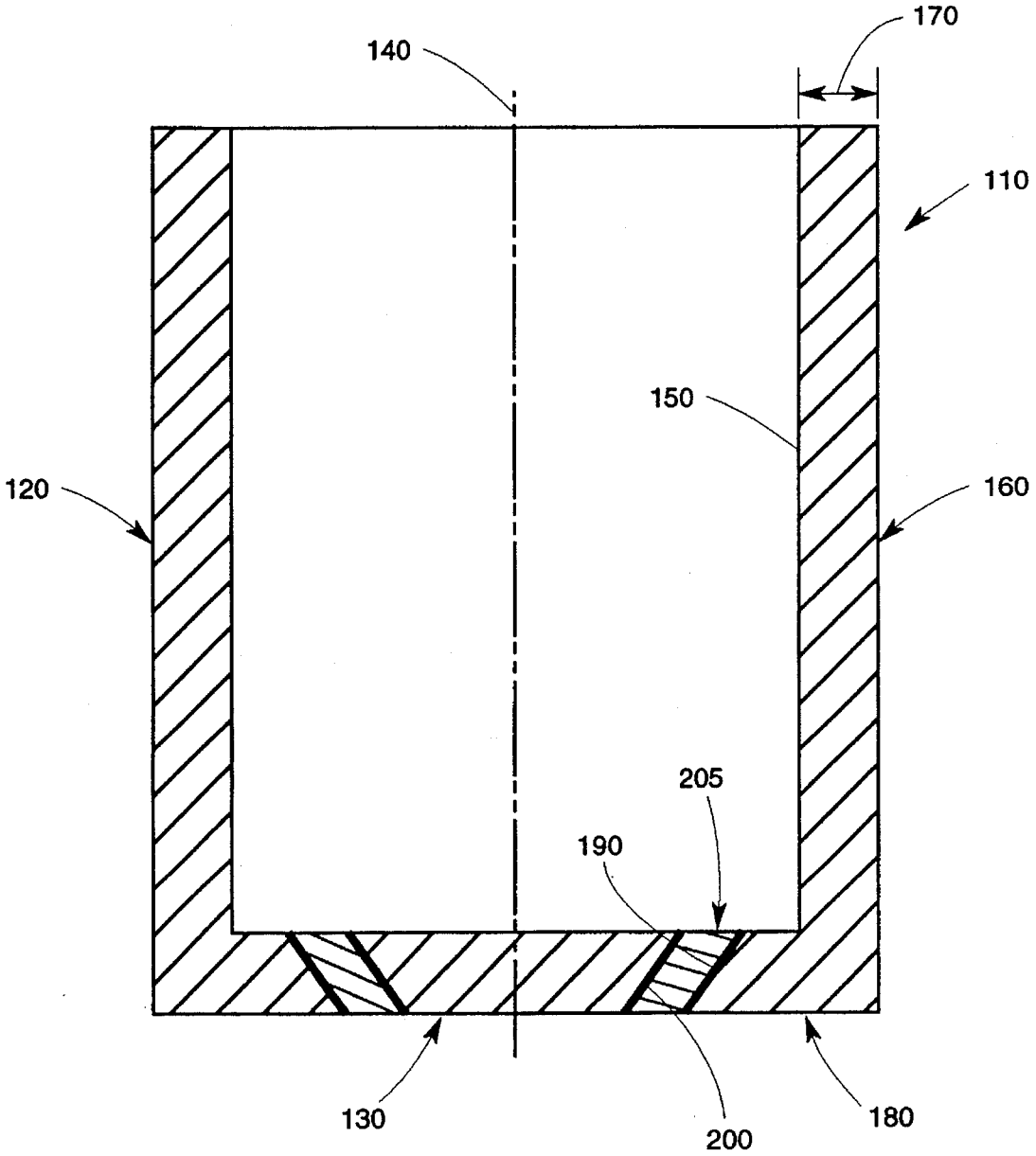
FIG. 2 is a cross-sectional view of another embodiment of a multi-piece crucible in accordance with the present invention.

Shown in FIG. 2 is another embodiment of the present invention. Crucible 110 comprises tubular member 120 and bottom member 130. Tubular member 120 has centerline 140, inner side wall 150, lower portion 160, thickness 170, and lip 180. Lip 180 is located on inner side wall 150 of lower portion 160 of tubular member 120. Lip 180 has tapered side 190 tapered in a downward direction toward centerline 140 of tubular member 120. Bottom member 130 has outer side 200 tapered in an upward direction toward tubular member 120 at an angle that provides a matching angle with tapered side 190 of lip 180 for enclosing lower portion 160 of tubular member 120 to form crucible 110 for containing a melt of a material in high temperature casting operations. Outer side 200 of bottom member 130 contacts ceramic sealing material 205 and tapered side 190 of lip 180 also contacts ceramic sealing material 205 to form a seal sufficient to contain a melt of a material used in high temperature casting operations. Lip 180 of tubular member 120 supports bottom member 130.

Figure 3:
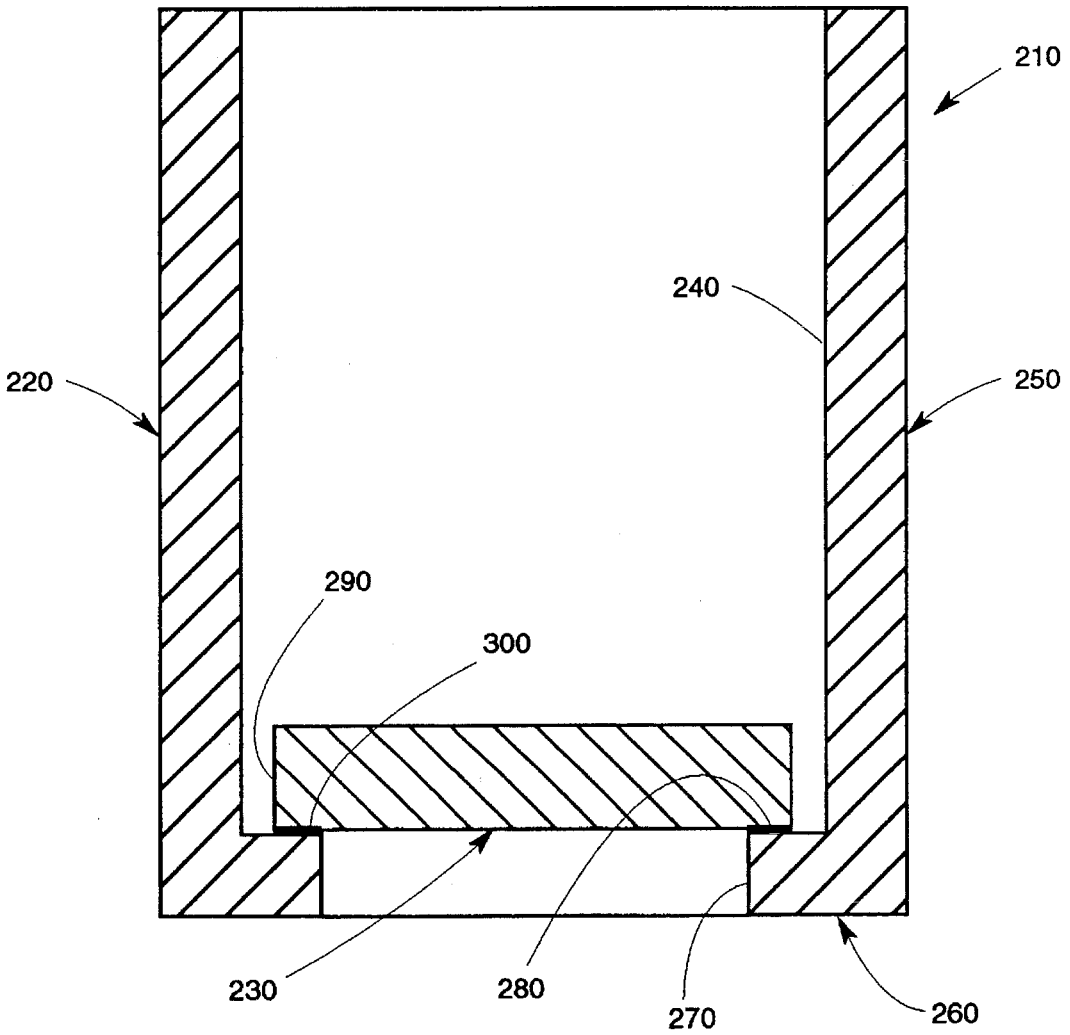
FIG. 3 is cross-sectional view of another embodiment of a multi-piece crucible in accordance with the present invention.

Shown in FIG. 3 is a further embodiment of the present invention. Crucible 210 comprises tubular member 220 and bottom member 230. Tubular member 220 has inner side wall 240, lower portion 250, and lip 260. Lip 260 is located on inner side wall 240 of lower portion 250 of tubular member 220. Lip 260 has side 270 and top portion 280. Bottom member 230 has outer side 290 and bottom portion 300. Outer side 290 of bottom member 230 has a periphery. Inner side wall 240 has a periphery. The periphery of outer side 290 of bottom member 230 is smaller than periphery of inner side wall 240. Bottom portion 300 of bottom member 230 contacts lower portion 280 of lip 260 to form a seal sufficient to contain a melt of a material used in high temperature casting operations. Lip 260 of tubular member 220 supports bottom member 230.

Figure 4:
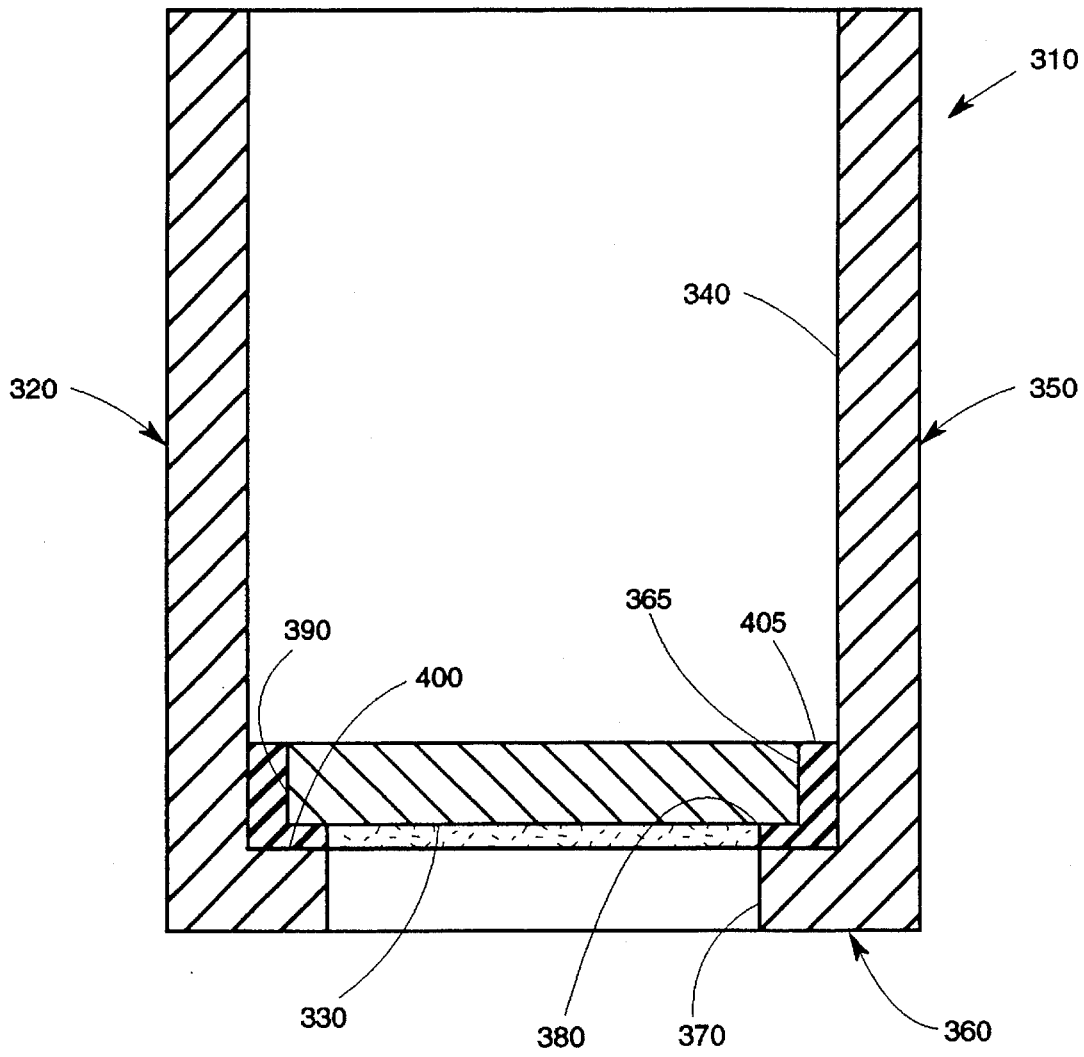
FIG. 4 is a cross-sectional view of another embodiment of a multi-piece crucible in accordance with the present invention.

Shown in FIG. 4 is still another embodiment of the present invention. Crucible 310 comprises tubular member 320 and bottom member 330. Tubular member 320 has inner side wall 340, lower portion 350, and lip 360. Inner side wall 340 of tubular 320 has lower wall portion 365. Lip 360 is located on inner side wall 340 of lower portion 350 of tubular member 320. Lip 360 has side 370 and top portion 380. Bottom member 330 has side 390 and bottom portion 400. Bottom portion 400 and side 390 of bottom member 330 contacts ceramic sealing material 405 and top portion 390 of lip 380 and lower wall portion 365 of inner side wall 340 contacts ceramic sealing material 405 to form a seal sufficient to contain melts of materials used in high temperature casting operations. Lip 360 of tubular member 320 supports bottom member 330.

Figure 5:
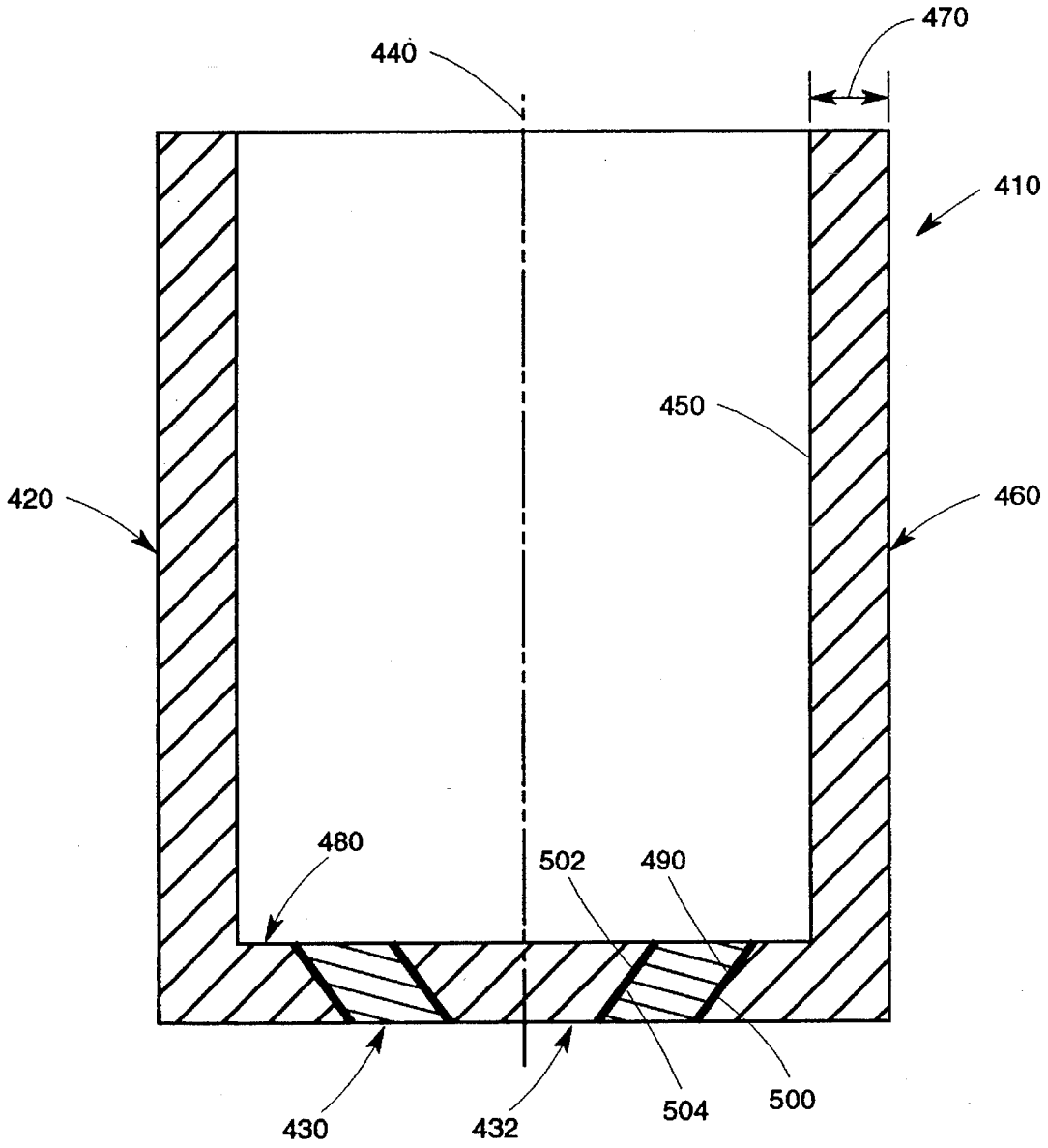
FIG. 5 is a cross-sectional view of another embodiment of a multi-piece crucible in accordance with the present invention.

Large multi-piece crucibles of the present invention can have more than two pieces. Shown in FIG. 5 is a cross-sectional view of one embodiment of a large multi-piece crucible of the present invention. Crucible 410 comprises tubular member 420 and bottom members 430 and 432. Tubular member 420 has centerline 440, inner side wall 450, lower portion 460, thickness 470, and lip 480. Lip 480 is located on inner side wall 450 of lower portion 460 of tubular member 420. Lip 480 has tapered side 490 tapered in a downward direction toward centerline 440 of tubular member 420. Bottom member 430 has outer side 500 and inner side 502. Outer side 500 is tapered in an upward direction toward tubular member 420 at an angle that provides a matching fit with tapered side 490 of lip 480. Inner side 502 of bottom member 430 is tapered in a downward direction toward centerline 440 of tubular member 420. Bottom member 432 has outer side 504. Outer side 504 of bottom member 432 is tapered in an upward direction toward tubular member 420 at an angle that provides a matching fit with inner side 502 of bottom member 430. Outer side 500 of bottom member 430 contacts tapered side 490 of lip 480 and outer side 504 of bottom member 432 contacts inner side 502 of bottom member 430. The contacts of outer side 500 of bottom member 430 with tapered side 490 of lip 480 and outer side 504 of bottom member 432 with inner side 502 of bottom member 430 form a seal sufficient to contain a melt of a material used in high temperature casting operations. Lip 480 of tubular member 420 supports bottom member 430 and bottom member 430 supports bottom member 432.

Figure 6:
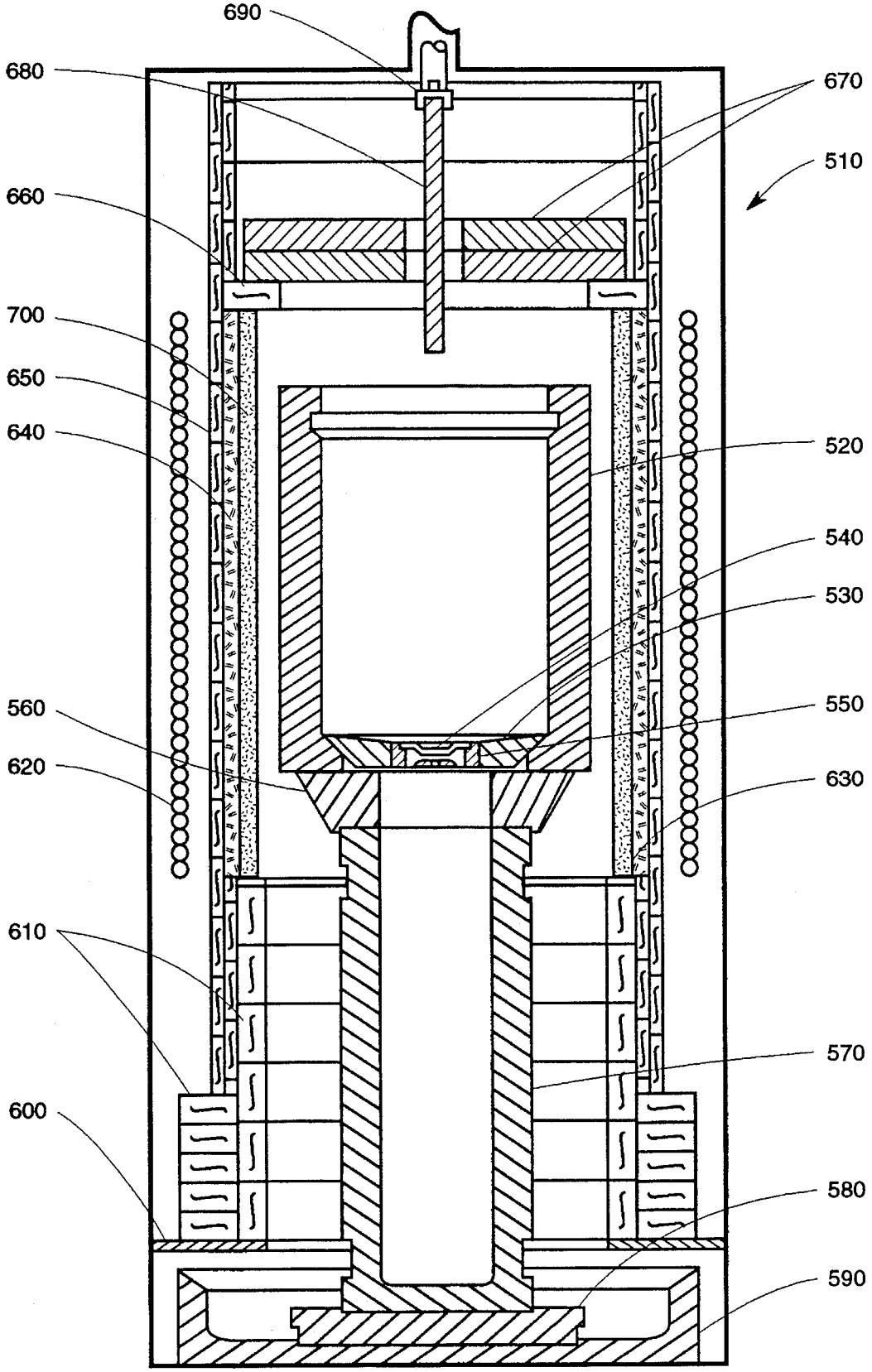
FIG. 6 is a cross-sectional view of a multi-piece crucible in accordance with the present invention installed in a furnace.

Shown in FIG. 6 is furnace 510 for making melt-casting metals and alloys. The refractory compositions used in the stack typically have melting points greater than 1650° C. Furnace 510 contains cast refractory materials: ceramic crucible 520, ceramic bottom insert 530, ceramic rupture disc 540, ceramic pour plug 550 all sitting on ceramic transition ring 560 which is sitting on ceramic billet mold 570 which is setting on nesting stack plate 580 which is setting on ceramic spill dish 590. Furnace 510 comprises steel base support 600, alumina bricks 610, susceptor coil 620, ceramic susceptor support ring 630, bubble zirconia insulation 640, 1425° C.–1650° C. firebrick 650, top alumina brick 660, molded 1650° C. insulating lid 670, ceramic pour rod 680, pour rod connector 690, and plasma sprayed tungsten susceptor 700.

Figure 7:
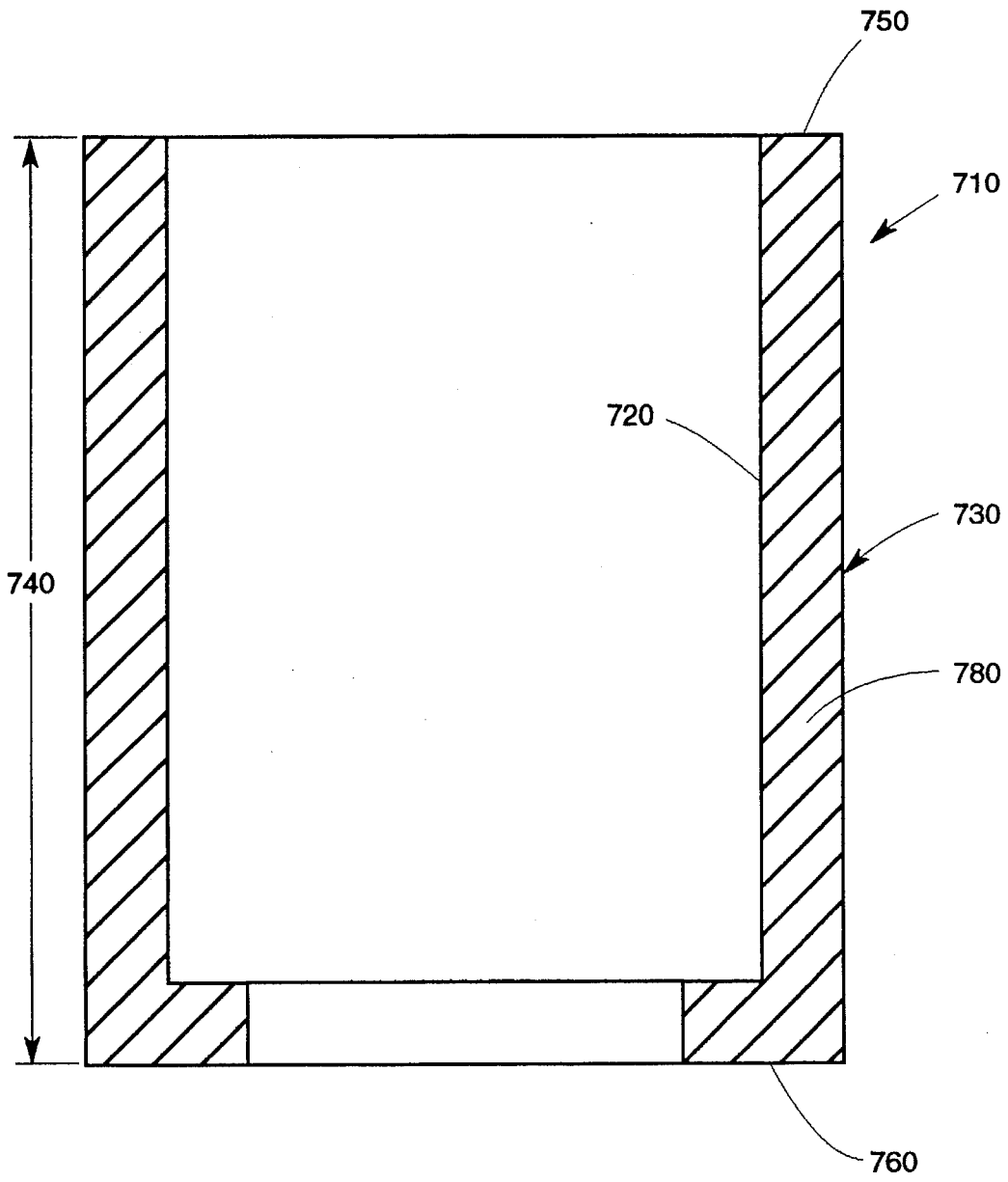
FIG. 7 is a cross-sectional view of another embodiment of a multi-piece crucible having a slotted tubular member in accordance with the present invention.

Shown in FIG. 7 is another embodiment of the present invention. Tubular member 710 of a multiple-piece crucible has inner side wall 720, lower portion 730, length 740, vertical slot 750 and lip 760. Vertical slot 750 has width 770, shown in FIG. 8. Vertical slot 750 traverses length 740 of tubular member 710. Vertical slot 750 is filled with ceramic sealing material 780 to form a seal sufficient to contain melts of materials used in high temperature casting operations and to provide for thermal expansion of tubular member 710 without cracking during the casting operations.

Figure 8:
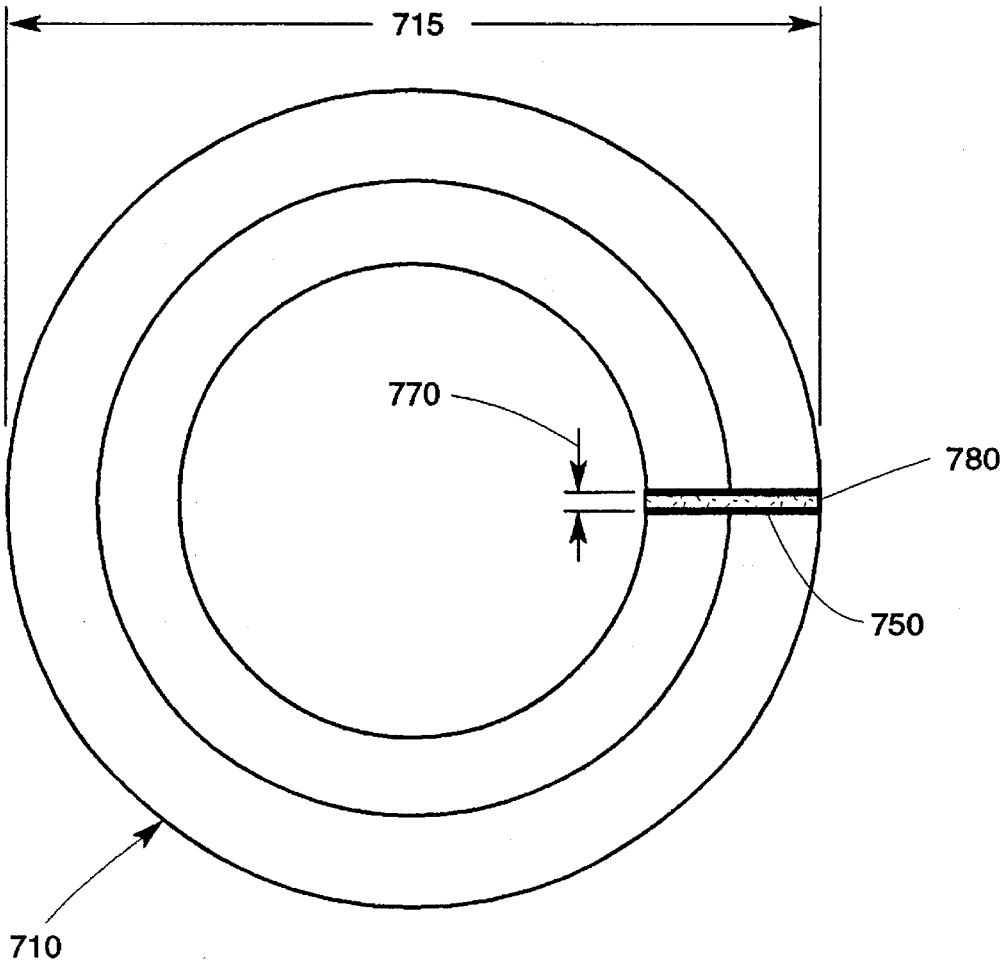
FIG. 8 is a cross-sectional top view through plane A—A of FIG. 7 in accordance with the present invention.

Shown in FIG. 8 is a cross-sectional top view of FIG. 7. Shown in FIG. 8 is vertical slot 750 in tubular member 710. Tubular member 710 has a diameter 715.

Several tests were run to check the effectiveness of different multi-piece crucible designs and materials of construction.

Large multi-piece ceramic crucibles with sizes ranging from 19" OD, 23" high to 30" OD, 22" high were successfully tested. The typical wall thickness of the crucibles ranged from 1⅞" to 2".

EXAMPLE I

A two-piece crucible of graphite was prepared by bonding a graphite tubular sidewall piece with a graphite bottom piece with a ceramic sealing material. The bonding was accomplished by coating the tapered side of the lip of the sidewall of the tubular sidewall piece and the tapered side of the bottom piece with a paste-like ceramic sealing material consisting of yttria mingled in an aqueous solution of sodium carboxymethyl cellulose and upon drying formed a seal and bond between the graphite tubular side wall piece and the graphite bottom piece of the two-piece crucible. The graphite bottom piece has a pour plug seated on a ledge-insert in the center of the graphite bottom section to facilitate the discharge of the melt into a mold upon the melting of the material charged in the crucible. The two-piece crucible was painted with an yttria wash coat, dried and then loaded with 180 kilograms of depleted uranium and placed in a vacuum furnace. The loaded crucible was heated in a vacuum to a temperature of 1315° C. for 0.5 hour to melt the depleted uranium. Then, the molten charge of depleted uranium was poured into a casting mold.

Examination of the two-piece crucible after the charge was poured out of the crucible indicated that none of the uranium charge had leaked from the crucible and that the crucible was free of cracks.

The test also indicated that the seal between the bottom piece and the tubular sidewall piece of the crucible held and no leakage of the molten charge was evident.

EXAMPLE II

A two-piece crucible was fabricated from a ceramic material containing the following constituents: 48 wt. % silicon carbide; 48 wt. % aluminum oxide; and 4 wt. % silicon oxide. The tapered side of the crucible bottom piece and the tapered side of the lip of the tubular sidewall piece were sealed together with the paste-like ceramic sealing material described in Example I and coated as described in Example I.

The two-piece crucible was loaded with 120 to 240 kilograms of uranium-2 wt. % niobium alloy and processed through a casting operation as described in Example I. Except, the alloy was heated to a temperature of 1385° C. in the casting operation with a six hour run time. A total of 12 melt/cast tests were run with the two-piece crucible. The two-piece crucible was examined for cracks and leaks after each test. These examinations indicated that none of the uranium alloy had leaked from the crucible and that the crucible was free of cracks. Consequently, the stresses created in one-piece ceramic crucibles by temperature differences during heating cycles can be alleviated by using the multi-piece crucible of the present invention.

EXAMPLE III

A two-piece crucible was fabricated using a different refractory ceramic material for the bottom plate. The tubular sidewall piece with the lip was fabricated from graphite and the bottom piece was fabricated from a refractory material containing the following constituents: 50 wt. % niobium; 30 wt. % titanium; and 20 wt. % tungsten. The bottom piece was then heavily nitrided by heat treating at about 1600° C. to about 1850° C. in nitrogen. The tapered side of the lip of the tubular sidewall piece and the tapered side of the bottom piece were sealed with a paste-like ceramic sealing material consisting of titanium nitride mingled in an aqueous solution of carboxymethyl cellulose and the assembled crucible was coated as described in Example I.

The two-piece crucible was loaded with uranium-2 wt. % niobium alloy and processed through a casting operation as described in Example II. Examination of the crucible after the casting operation indicated that none of the uranium-2 wt. % niobium alloy leaked from the crucible and that the crucible tubular sidewall piece and the bottom piece were free of cracks.

Crucibles having bottom pieces 20" in diameter did not crack. The tubular side wall piece of the crucible works best if it is as close to being a free-standing cylinder as possible. The preferred crucible design seems to be the small-ledge crucible design rather than the "valve seat" design. However, all the variations tested worked well: valve seat long taper, valve seat truncated taper on housing, small-ledge, clover-leaf taper all work to reduce thermally induced stresses and prevent crucible cracking. One of the causes of crucible cracking is the use of a cylindrical susceptor to drive the heat into and through the crucible to the charge of material to be melted. The susceptor can be graphite, plasma-sprayed tungsten, molybdenum (i.e., a riveted, dovetailed interlocking solid ¼" thick metallic molybdenum susceptor worked well), or any refractory metal or conductor. The susceptor picks up the induction field and heats. The heat is transmitted, generally by radiation (or convection if argon or other gas is used for the environment; by radiation alone in vacuum) to the crucible and charge. Since the susceptor designs are right-circular cylinders that are larger in diameter than the crucibles, the heat is transmitted to the outer diameter of the crucible where it is conducted through to the inside of the crucible. The charge is heated by radiation from the inner wall of the crucible and through the bottom by conduction. However, the bottom middle of the crucible is the farthest from the heat-source susceptor and thus is the last to heat, generally very sluggish in attaining temperature. The studies indicate that cracking occurs very early in the heating cycle, while the interior is cool and the outside is several hundreds of degrees higher in temperature, creating a large temperature differential, delta T, from the outside wall to the center of the crucible. Generally the multi-piece crucible prevents the temperature differential from causing enough stress to crack or break the crucible. During the heating cycle the tubular side wall of the crucible expands, and the bottom piece slides on the ledge or sloped section, thereby reducing or eliminating any stress caused by the expansion.

With single piece crucibles cracking usually occurs at the point where the bottom of the crucible meets the side wall of the crucible and/or radial cracks emanating from the center of the crucible bottom.

The use of silicon carbide-loaded ceramics (essentially mullite-aluminum oxide formulations loaded with silicon carbide) will reduce the temperature differentials, since the combination of a good thermal conductor (silicon carbide) with the poorly conducting oxide ceramic yields a better overall thermal conductor, thus reducing the temperature differentials. However, high-alumina compositions (such as the 92.5 to 95% alumina, remainder silica) appear to still work well in the multi-piece crucibles; thus, if, for some reason, silicon carbide is not desired, it is not required. Silicon carbide materials react with oxides in vacuum to yield silicon monoxide at 1450° to 1550° C., limiting the upper use-temperature utility in vacuum to about 1500° C. with those materials.

A multi-piece crucible made from a refractory metal alloy composition was tested. The refractory metal alloy called Tribocor 532N, a trademark of Fansteel, Inc., is a nitrided refractory metal alloy consisting essentially of 50 wt. % titanium, 30% niobium, and 20% tungsten, generally nitrided at 1875° C. for 4 hours to yield a surface of titanium nitride. The Tribocor 532N is a heavily nitrided metal (1.6 mm nitride-affected depth, with 0.25 mm of a mostly nitride outer layer consisting mostly of titanium nitride). In the initial test a straight edged (non-tapered) Tribocor bottom piece having a thermal expansion similar to alumina, $8\times10^{-6}$/° C. was used with a graphite tubular side wall piece having a straight edged lip and a thermal expansion of about $4\times10^{-6}$/° C. The graphite tubular side wall piece broke, spilling the melt and damaging the Tribocor bottom piece, when the crucible was heated. The bottom piece was repaired by brazing and the edge was tapered. The Tribocor bottom piece having the tapered edge was then tested with a graphite tubular side wall piece having a tapered lip which matched the tapered edge of the bottom piece. A ceramic sealing paste used for this test comprised a binder/suspension of 50 wt. % titanium nitride powder in an aqueous solution of 6 wt. % sodium carboxymethyl cellulose. The multi-piece crucible using the tapered edges worked well, with no cracks developing or spilling of the melted material. This test demonstrates that the tapered edges "valve seat" arrangement works well for a multi-piece crucible utilizing materials with dissimilar thermal expansions for the crucible bottom and tubular side wall.

The ceramic sealing paste used for grouting the pieces of the multi-piece crucible together is a precaution to insure the molten material will not leak out of the crucible during the melting operation when melting materials which have a low viscosity and a high density.

One of the ceramic sealing pastes used comprises a binder/suspension of 50 wt.% yttrium oxide powder in a aqueous solution of 6 wt. % sodium carboxymethyl cellulose. The ceramic sealing paste is used for sealing areas between the pieces of the multi-piece crucibles. For very large gaps, the yttria based paste can be modified by adding zirconia bubbles (typically 1/16" in diameter) as a filler. The ceramic sealing paste forms a layer of weakly-bonded yttria particles that allows movement of the joined sections while not sintering to a hard, dense ceramic. The dried paste is easily scraped off after a run if needed. Generally, however, the joined sections can be reused as is by applying another coating of ceramic sealing paste without any further changes.

The multi-piece crucible system allows vacuum induction melting of reactive metals without the use of graphite components. There is no known production scale graphite-free system for induction melting/casting reactive metals (including specialty steels, titanium and titanium alloys, zirconium and zirconium alloys, beryllium and beryllium alloys, or uranium and uranium alloys). The multi-piece crucible enables these reactive metals to be processed by vacuum induction melting, a standard, economical technique that is used for less-reactive metals and alloy materials that can utilize graphite. The uniqueness of the non-graphite multi-piece crucible is that it withstands thermal stresses that must be withstood when the process cycle time is minimized in order for vacuum induction melting to be economically competitive on a production basis. Additionally, the multi-piece crucible can be readily substituted for graphite in normal vacuum induction melting operations. For alloys that react with carbon or graphite, there has been no alternative but to are melt them, a very expensive processing method compared to vacuum induction melting. Thus the present invention opens up the reactive metal melting/casting area for utilization of standard, economical vacuum induction melting.

Other materials can be combined to provide nonreactive surfaces for containing a specific material during induction-heating operations. For example, silicon carbide at levels of to 85 wt. % can be combined with ceramic oxides (primarily alumina with some silica) to improve the thermal conductivity of the ceramics for induction heating operations. Various materials for the construction of the multi-piece crucibles were used in the tests. For example the tubular side wall piece and the bottom piece of the non-graphite crucibles were made from a material selected from the group comprising graphite; silicon carbide; ceramic composition comprising 48 wt. % silicon carbide, 48 wt. % aluminum oxide, and 4 wt. % silicon oxide; ceramic composition comprising 90 % alumina and 9.5% silicon dioxide; ceramic composition comprising 61.5% alumina, 33% silicon carbide, and 4.7% silicon dioxide; ceramic composition comprising 48% alumina, 48% silicon carbide, and 4% silicon dioxide; ceramic composition comprising 35% alumina, 59% silicon carbide, and 5% silicon dioxide; ceramic composition comprising 29.4% alumina, 67.5% silicon carbide, and 3.7% silicon dioxide; and refractory metal alloy composition from Fansteel, Inc. called Tribocor 532N comprising 50% niobium, 30% titanium and 20% tungsten in which the outer layer of the piece made from such composition consisted essentially of titanium nitride and combinations thereof. Consequently, a crucible of the present invention can be used for heating specialty steels, titanium metal and titanium alloys, zirconium metal and zirconium alloys, and beryllium metal and beryllium alloys.

The multiple-piece crucible can be utilized in the induction-melting of uranium metal and uranium alloys. Usually, induction melting operations are more efficient than arc-melting operations. Also, the multiple-piece crucible can lessen the carbon contamination of uranium metal and uranium alloys during casting operations. As a result, the recycle of uranium scrap can be increased and waste minimization would be enhanced.

In addition, a multiple-piece crucible of the present invention can be used in casting specialty steels, titanium metal and titanium alloys, zirconium metal and zirconium alloys, and beryllium metal and beryllium alloys.

The problem in heating foundry crucibles is to heat ceramic crucibles uniformly so as to reduce or eliminate the thermal stresses or temperature differentials (delta Ts) that occur with induction heating. Melt-cast operations generally use induction heating with a suscepting crucible: the crucible picks up the induction field and heats inductively, thereby heating the metal charge by conduction and radiation from the crucible. When graphite is used for the crucible, it is also a susceptor—thus absorbing the induction field and heating directly. When ceramic crucibles are used, they do not suscept. Therefore, a separate susceptor is generally used. This susceptor heats up and radiates the heat to the crucible and metal charge contained therein. Generally, the susceptor is a cylinder of an electrically conductive material, such as refractory metal (molybdenum, tungsten, tantalum, or niobium) or graphite. Also, generally, the susceptor is fixed in the furnace actually bricked into place on the sidewall of the furnace. Typical of such a design is the carbon-free induction furnace (U.S. Pat. No. 4,550,412). Typical of the improvements necessary to reduce the thermal stresses on the crucible is the use of a multiple-pieced ceramic crucible.

However, there is a need to expeditiously heat crucibles to conduct the melt-cast operations in a timely manner: that is, an infinitely slow heating to a casting temperature is unacceptable (although ceramic crucibles would not crack if heated in that manner); likewise, using multiple-piece crucibles allows faster heating, but still can crack if sufficient thermal stresses (delta Ts) develop. Thus, a manner was sought to minimize the thermal stresses on a ceramic crucible while allowing heating of the crucible as fast as possible. The ideal way to heat a ceramic is to envelop (or bathe) the crucible in a totally uniform thermal environment—where the crucible is heated the same from the top, bottom, and sides. In practice, inside a large-sized crucible that is heated by radiation from a cylindrical susceptor, the heat travels inward towards the center of the crucible: the center is the coolest spot, and there is a constant temperature differential from the crucible sidewall to its middle. The findings of this disclosure show that a "thermal can" will provide almost ideal uniform heating conditions, with all the thermal differentials being <200° C. even as the system (susceptor, crucible, and metal charge) heats upwards to the casting temperature.

Results indicate that two-piece ceramic crucibles perform well, yet may exhibit barely discernable cracks on the inside only when tested with embedded susceptors of tungsten or molybdenum. The embedded susceptors are those which are actually permanently mounted on refractory brick ledges in the furnace and with refractory fiber or bubble insulation behind the susceptor adjacent to the brickwork. These embedded susceptors are not in any direct contact with the crucible/mold assembly, and all heat is directed radially inward from the susceptor towards the crucible/mold assembly.

The first test with a two-piece ceramic crucible was done with a graphite susceptor which had a bottom graphite plate to support it on the crucible/mold stack and which had a graphite top plate used for supporting the refractory insulating brick. This system performed excellently, leading to 12 melt/pour cycles with the same two-piece ceramic crucible with absolutely no cracking (internal or external). What was not realized at the initial testing was that the system was actually a "thermal can." The "thermal can" basically allowed the heat to uniformly bathe the crucible as it heats up. Without the "thermal can," we had demonstrated many times that some degree of cracking commonly occurs when reasonable heating times were utilized (i.e., 3 to 4 hours to 1000° C.). However, we have also demonstrated that even one-piece crucibles of these large sizes (up to 23–24" OD) CAN be heated slowly enough to prevent cracking; i.e., heating at 100° C./h up to 1000° C. generally resulted in no cracks and led to successful melting of uranium alloy (U-2 Nb) at 1385° C. (30 min. hold [or "soak"]) metal temperature. Likewise, two-piece crucibles exhibited no cracks when an 8–10 hour heatup to 1385° C.

was used. A minimum casting cycle type has an economic advantage and, for general foundry operations, an <8-hr. melt/cast time is desirable.

The "thermal can" plus the two-piece crucible is thought to be the best means to minimize the casting cycle time and reduce the tendency of large ceramic crucibles to crack. The use of ceramics that are all [or nearly all] alumina (90–95 wt. % alumina, re. silica) appears OK when both two-pieced crucibles and the "thermal can" are used together. There is a somewhat improved performance in better distributing the temperature if silicon carbide-mullite formulations are used for the ceramic components of the crucible: this is because of the enhanced thermal conductivity of the ceramic from the mixture of silicon carbide and mullite as opposed to all mullite or mullite-alumina. There is reason to eliminate the silicon carbide if possible for vacuum-induction-melting (VIM) operations: vacuum enhances the production of silicon monoxide from the silicon carbide plus silicon oxide (or aluminum oxide), so that the practical upper limit of operation is about 1500° C. with a silicon carbide-mullite crucible, whereas alumina or alumina-mullite crucibles are operable to >1700° C. The "thermal can" appears to be a more-useful way of evening out the temperature around the crucible than addition of silicon carbide in the ceramic.

Actual experimental results with graphite top and bottom plates but using an embedded molybdenum susceptor [24"OD, 40"L] (not touching the graphite plates) led to very large thermal differentials, since the gap between the graphite and the Mo did not allow direct conduction of the susceptor heat to the top and bottom of the crucible.

An experiment was conducted using a ring of stacked molybdenum susceptors (each ring about 6"H, using 4 rings) with graphite top and bottom plates in contact with the susceptor creating the "thermal can". A Blasch Precision Ceramics Co. two-piece crucible with minimal-ledge design (BP-67/8-SC: composition 67.5 wt. % SiC, 29.4% $Al_2O_3$, 3.7% $SiO_2$) was used for the test. Thermal differentials from exterior-to-interior sidewall of the crucible were quite low, generally below 150° C. This 125 kg. melt test further demonstrated that the "thermal can" was useful.

An experiment was undertaken to see if the "thermal can" could be "tweeked" to modify the thermal differentials. Using graphite susceptor and top and bottom plates, the diameter of the bottom plate was increased over that of the cylindrical graphite susceptor, thus making the bottom plate closer to the induction coils. The bottom plate was 25" OD as compared to the previously used 23" OD bottom plate and the 23" cylindrical graphite susceptor. Temperatures were measured on the crucible outer and inner walls, on the graphite lid (supporting the insulting brick), on the bottom graphite support flange, on the graphite susceptor, and on the bottom stack support (which was a graphite crucible for this test). The thermal profile, followed to 1000° C., established that the temperature differentials from the susceptor to lid or to bottom were held to <120° C.—a remarkable event. This experiment established that thermal differentials can be minimized by changing the components of the "thermal can". With the large .(25" OD) graphite bottom plate, temperature differentials from the susceptor to the bottom plate were only half as much (<120° C.) as those observed for the small-diameter bottom plate (250° C.).

An all-metal "thermal can" was the next experiment for thermal profiling. Molybdenum stacking/interlocking rings were used as the susceptor. The bottom and top plates were made of niobium metal. The top plate supported two layers (ea. 1 ½) of molded-ceramic fiber insulation. Throughout the testing (to 1000° C.), the top plate and susceptor were <50° C. apart. However, the bottom plate temperature differential from the susceptor increased over the run, finally reaching somewhat over 300° C. This differential is expected to be lowered by increasing the diameter of the niobium plate in the same fashion as for the graphite plate. In any case, the differentials between the outside and inside of the crucible walls were kept below 200° C. The "thermal can" of all-metal has been established for reducing thermal differentials and heating ceramic crucibles in a way that will minimize the thermal stresses.

Further testing has showed that adding a bottom section onto the "thermal can" better distributes the heat in the critical bottom region. Using molybdenum stacking/interlocking rings for the system, the bottom region looks like two washers. Both washers were made of niobium (not because of any reason other than availability) and were spaced apart with ONE molybdenum ring. The crucible was supported by the top washer. The bottom washer rested on insulating pads on a mold support ceramic. The molybdenum ring provided about 6" of gap underneath the crucible, between the crucible and the mold into which the metal was to be cast.

This setup allowed the best thermal conditions of any tested to date.

A Tribocor (50 wt. % niobium, 30% titanium, 20% tungsten—nitrided for a titanium nitride surface) susceptor was used to make a "thermal can". Because of its height (dimensions were 24" OD, 20" high), a molybdenum ring was placed on top to clear the crucible. The interesting observation was that Tribocor heats inductively better than graphite. And, with the "thermal can" arrangement, the temperature exposure of the crucible is uniform—a bathing of the crucible in uniform temperature as it heats up to the melt temperatures.

The degree of uniformity of the temperatures can, as mentioned above, be varied somewhat by changing the diameters of the washers on the bottom and top as well as the thicknesses of the refractory metals utilized and with the type of susceptor materials used (molybdenum, niobium, Tribocor, etc.). Also, certain applications (load [support] areas as on the bottom) may require the best hot strengths, probably suggesting Tribocor. But, these can be designed around by using ceramic brick spacers (as between the bottom washers, etc.) or some other means. The important discovery is that a can-shaped susceptor/enclosure allows ceramic crucibles to be heated inductively in a uniform manner, preventing cracking problems and essentially allowing the ceramic systems to behave like graphite when being heated in a rapid manner up to melting temperatures.

The invention can allow very large carbon,free systems for melting/casting of special reactive metals (uranium, titanium, beryllium, lithium, and alloys thereof). Previously, systems for heating the ceramics to avoid cracking have not existed, so the carbon-free systems are not generally used. This development should allow large ceramic crucibles to be used in foundry practice essentially as graphite would be used—similar heating rates, etc. Also, since the "thermal can" is affixed to the melt/cast stack, a furnace can be run with a graphite system one day and with a carbon-free system the next day—providing considerably versatility. The systems generally can be changed by changing the refractory materials—as mentioned, using molybdenum, tungsten, niobium, tantalum, Tribocor. Also, interlocking rings can be used or a single cylinder of material to make the cylindrical section of the "thermal can".

This system will likely be used for melting and casting high-purity alloys, where carbon contamination is deleterious to the alloy properties. For reactive metal melting, carbon contamination is generally not desirable—often "killing" the cast parts. Thus, carbon-free melt-cast systems are sought. Arc melting is one carbon-free-alternative, but it is much more costly than vacuum induction melting (VIM), which is utilized with the "thermal can" to allow ceramic (noncarbon) crucibles to be effectively used. Uses in VIM operations with high purity alloys could nearly eliminate carbon contamination, allowing for recycle of reactive (high-surface-area) scrap such as chips as well as massive scrap.

Figure 9:
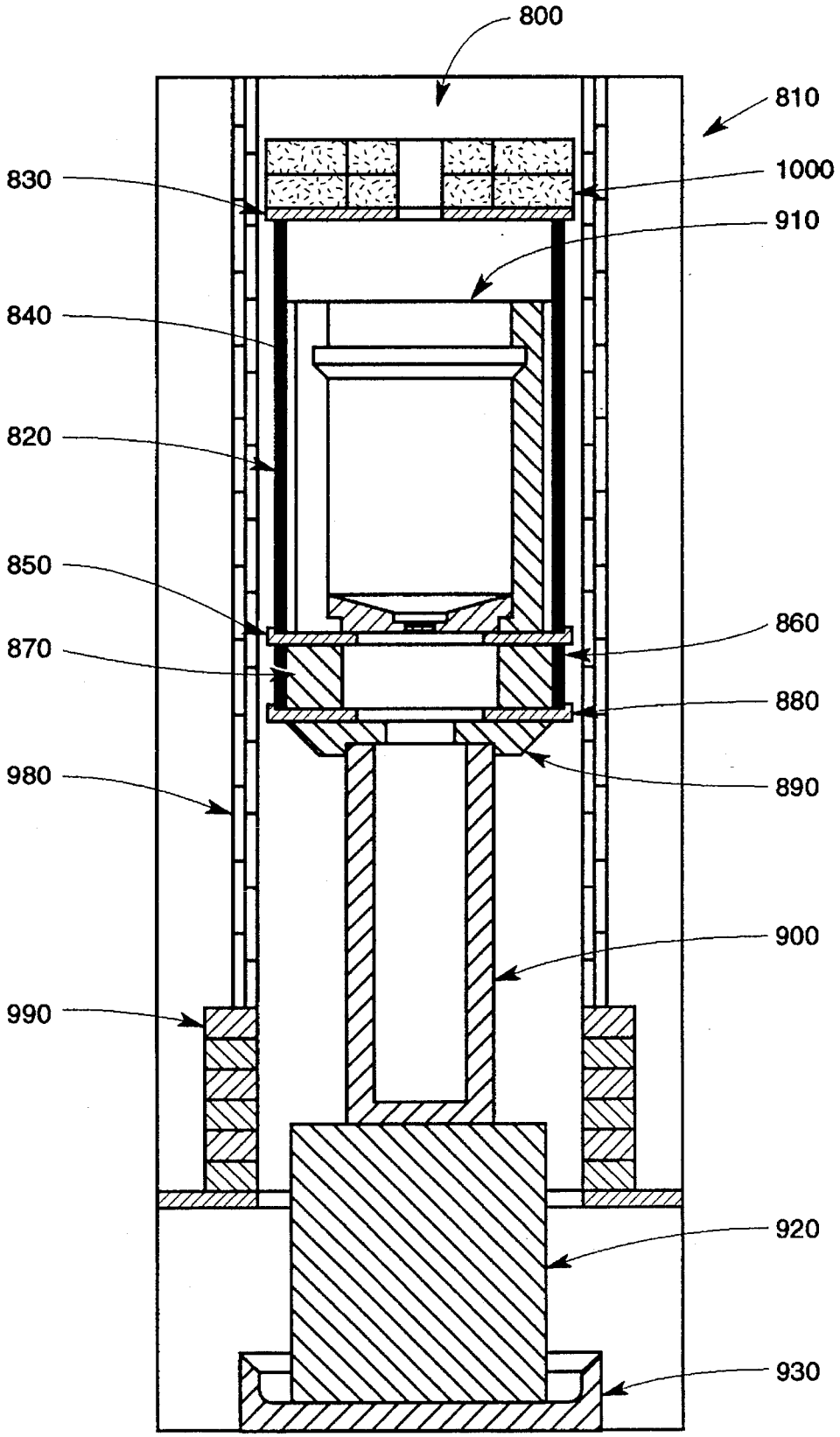
FIG. 9 is a cross-sectional view of a thermal can assembly containing a multi-piece crucible having a slotted tubular member in a foundry furnace in accordance with the present invention.

Shown in FIG. 9 is a cross-sectional view of thermal can assembly 800 in foundry furnace 810. Thermal can assembly 800 comprises thermal can 820, thermal can middle susceptor plate 850 with aperature 855, thermal can spacer blocks 870, multiple-piece susceptor plate 850 with aperature 855, thermal can spacer blocks 870, multiple-piece crucible 910, transition ring 890 with aperature 895, billet mold 900 with cavity 905 open a top 902 of billet mold 900 to accept molten material from multiple-piece crucible 910, mold stack block 920, and spill dish 930. Thermal can 820 comprises thermal can top susceptor plate 830 with aperature 835, first thermal can susceptor ring 840, tubular shapped, second thermal can susceptor ring 860, tubular shapped, and thermal can bottom susceptor plate 880 with aperature 885. Thermal can top susceptor plate 830, first thermal can susceptor ring 840, thermal can middle susceptor plate 850, second thermal can susceptor ring 860, and thermal can bottom susceptor plate 880 are made from susceptor material. Multiple-piece crucible 910 comprises multiple-piece crucible slotted tubular member 950 having a vertical slot 955, rupture disc 960, and multiple-piece crucible bottom 970 with aperature 975. Rupture disc 960 coacts with aperature 975 to prevent molten metal from running out of multiple-piece crucible until rupture disc 960 is ruptured to allow the molten metal to flow into cavity 905 of billet mold 900. Thermal can 820 is in contact with and sets on top of transition ring 890 which is in contact with and sets on top of billet mold 900 which is in contact with and sets on top of mold stack block 920 which sets on top of spill dish 930. Multiple-piece crucible 910 is contained in thermal can 820 and sets on top of thermal can middle susceptor plate 850. Thermal can top susceptor plate 830 is in contact with and sets on top of first thermal can susceptor ring 840 which is in contact with and sets on top of thermal can middle susceptor plate 850 which is in contact with and sets on top of second thermal can susceptor ring 860 which is in contact with and sets on top of thermal can bottom susceptor plate 880 which is in contact with and sets on top of transition ring 890. Transition ring 890 is in contact with billet mold 900 and thermal can bottom susceptor plate 880. Thermal can spacer block 870 is sandwiched between and in contact with thermal can middle susceptor plate 850 and thermal can bottom susceptor plate 880. Side insulating bricks 980 of foundry furnace 810 are supported by support bricks 990. Insulating bricks 1000 set on top of thermal can top susceptor plate 830. Thermal can spacer block 870 and transition ring 890 are made of a refractory ceramic material and will not yield to the loading forces caused by the multiple-piece crucible containing a charge of material for melting even at the operating temperatures of foundry furnace 810. Thermal can spacer block 870 and transition ring 890 as well as transition ring 890, billet mold 900, mold stack block 920, and spill dish 930 support thermal can middle susceptor plate 850 and multiple-piece crucible 910.

While there has been shown and described what is at present considered the preferred embodiments of the invention, it will be obvious to those skilled in the art that various changes and modifications may be made therein without departing from the scope of the invention as defined by the appended claims.

What is claimed is:

1. A multi-piece crucible for containing a melt of a material for high temperature applications comprising: a tubular member and a bottom member, said tubular member having a centerline, an inner side wall, a lower portion, a thickness, and a lip, said lip being located on said inner side wall of said lower portion of said tubular member, said lip having a tapered side tapered in a downward direction toward said centerline of said tubular member, said bottom member having an outer side tapered in an upward direction toward said tubular member at an angle that provides a matching angle with said tapered side of said lip for enclosing said lower portion of said tubular member to form said crucible for containing said melt of said material in high temperature casting operations, said outer side of said bottom member contacting a ceramic sealing material and said tapered side of said lip contacting said ceramic sealing material forming a seal sufficient to contain said melt of said material used in high temperature casting operations, said lip of said tubular member supporting said bottom member, said crucible being made of a material chemically inert to said melt and having structural integrity at the melting point temperature of said melt, said tubular member has a length and a vertical portion of said tubular member removed to form a vertical slot, said vertical slot traversing said length and said thickness said tubular member to provide for expansion or contraction of said tubular member to prevent cracking of said tubular member, said vertical slot being filled with a ceramic sealing material.

2. A crucible in accordance with claim 1 wherein said ceramic sealing material is prepared by drying a ceramic sealing material comprising yttria mingled in an aqueous solution of sodium carboxymethyl cellulose.

3. A crucible in accordance with claim 1 wherein said ceramic sealing material is prepared by drying a ceramic sealing material comprising titanium nitride mingled in an aqueous solution of sodium carboxymethyl cellulose.

4. A multi-piece crucible for containing a melt of a material for high temperature applications comprising: a tubular member and a bottom member, said tubular member having an inner side wall, a lower portion, and a lip, said lip being located on said inner side wall of said lower portion of said tubular member, said lip having a side and a top portion, said bottom member having a side and a bottom portion, said lip of said tubular member supporting said bottom member, said bottom of said bottom member contacting a ceramic sealing material and said top portion of said lip contacting said ceramic sealing material forming a seal sufficient to contain said melt of said material used in high temperature casting operations, said crucible being made of a material chemically inert to said melt and having structural integrity at the melting point temperature of said melt, said tubular member has a length and a vertical portion of said tubular member removed to form a vertical slot, said vertical slot traversing said length and said thickness said tubular member to provide for expansion or contraction of said tubular member to prevent cracking of said tubular member, said vertical slot being filled with a ceramic sealing material.

5. A crucible in accordance with claim 4 wherein said ceramic sealing material is prepared by drying a ceramic sealing material comprising yttria mingled in an aqueous solution of sodium carboxymethyl cellulose.

6. A crucible in accordance with claim 4 wherein said ceramic sealing material is prepared by drying a ceramic sealing material comprising titanium nitride mingled in an aqueous solution of sodium carboxymethyl cellulose.

7. A large multi-piece crucible having more than two pieces for containing a melt of a material for high temperature applications comprising: tubular member and at least two bottom members, a first bottom member and a second bottom member, said tubular member having an inner side wall, a lower portion, and a lip, said lip being located on said inner side wall of said lower portion of said tubular member, said second bottom member fitting inside said first bottom member, said tubular member having a centerline, an inner side wall, a lower portion, a thickness, and a lip, said lip being located on said inner side wall of said lower portion of said tubular member, said lip having a tapered side tapered in a downward direction toward said centerline of said tubular member, said first bottom member having an outer side and an inner side, said outer side of said first bottom member being tapered in an upward direction toward said tubular member at an angle that provides a matching fit with said tapered side of said lip of said tubular member, said inner side of said first bottom member being tapered in a downward direction toward said centerline of said tubular member, said second bottom member having an outer side, said outer side of said second bottom member being tapered in an upward direction toward said tubular member at an angle that provides a matching fit with said inner side of said first bottom member, said first bottom member and said second bottom member enclosing said lower portion of said tubular member forming said crucible for containing said melt of said material in high temperature casting operations, said outer side of said first bottom member contacting said tapered side of said lip of said tubular member and said outer side of said second bottom member contacting said inner side of said first bottom member both forming a seal sufficient to contain said melt of said material used in high temperature casting operations, said lip of said tubular member supporting said first bottom member and said first bottom member supporting said second bottom member, said tubular member has a length and a vertical portion of said tubular member removed to form a vertical slot, said vertical slot traversing said length and said thickness said tubular member to provide for expansion or contraction of said tubular member to prevent cracking of said tubular member, said vertical slot being filled with a ceramic sealing material.

8. A crucible in accordance with claim 7 wherein said ceramic sealing material is prepared by drying a ceramic sealing material comprising yttria mingled in an aqueous solution of sodium carboxymethyl cellulose.

9. A crucible in accordance with claim 7 wherein said ceramic sealing material is prepared by drying a ceramic sealing material comprising titanium nitride mingled in an aqueous solution of sodium carboxymethyl cellulose.

10. A thermal can assembly comprising a thermal can, a multiple-piece crucible, a thermal can middle susceptor plate having an aperature, a thermal can spacer block, a transition ring having an aperature, and a billet mold having a top and a cavity, said cavity open at said top of said billet mold; said thermal can comprises a thermal can top susceptor plate having an aperature, a first thermal can susceptor ring tubular in shape, a second thermal can susceptor ring tubular in shape, and a thermal can bottom susceptor plate having an aperature; said thermal can is made from susceptor material; said thermal can sets on top of said transition ring and said transition ring sets on top of said billet mold; said multiple-piece crucible is contained in said thermal can and sets on top of said thermal can middle susceptor plate, said thermal can middle susceptor plate sets on top of said thermal can spacer block, said thermal can spacer block sets on top of said thermal can bottom susceptor plate; said thermal can top susceptor plate is in contact with and sets on top of said first thermal can susceptor ring, said first thermal can susceptor ring is in contact with and sets on top of said thermal can middle susceptor plate, said thermal can middle susceptor plate is in contact with and sets on top of said thermal can spacer block and said second thermal can susceptor ring, said thermal can spacer block and said second thermal can susceptor plate are in contact with and sets on top of said thermal can bottom susceptor plate, said thermal can bottom susceptor plate is in contact with and sets on top of said transition ring, said transition ring is in contact with and sets on top of said billet mold.

11. A thermal can assembly in accordance with claim 10 wherein said multiple-piece crucible comprises a multiple-piece crucible slotted tubular member having a vertical slot, a rupture disc, and a multiple-piece crucible bottom having an aperature, said multiple-piece crucible bottom is in contact with and sets on top of said thermal can middle susceptor plate.

12. A thermal can assembly in accordance with claim 10 wherein said billet mold sets on top of a mold stack block and said mold stack block sets on top of a spill dish.

13. A thermal can assembly in accordance with claim 10 wherein said thermal can spacer block and said transition ring are made of refractory ceramic material.

* * * * *